US007696851B1

(12) United States Patent
Ger et al.

(10) Patent No.: US 7,696,851 B1
(45) Date of Patent: Apr. 13, 2010

(54) TRANSFORMER WITH SEPARATED BOBBIN

(75) Inventors: Chih-Chan Ger, Jhongli (TW); Chia-Kun Chen, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 0 days.

(21) Appl. No.: 12/469,658

(22) Filed: May 20, 2009

(30) Foreign Application Priority Data

Oct. 24, 2008 (CN) ..... 2008 2 0212753

(51) Int. Cl.

| | |
|---|---|
| ***H01F 27/30*** | (2006.01) |
| ***H01F 21/06*** | (2006.01) |
| ***H01F 5/00*** | (2006.01) |
| ***H01F 27/24*** | (2006.01) |
| ***H01F 27/28*** | (2006.01) |

(52) U.S. Cl. ..... 336/198; 336/131; 336/200; 336/212; 336/220

(58) Field of Classification Search ..... 336/90, 336/221, 220, 232, 198, 131
See application file for complete search history.

(56) References Cited

U.S. PATENT DOCUMENTS 4,857,876 A * 8/1989 Costa ..... 336/165
7,199,694 B2 * 4/2007 Hao ..... 336/208
7,528,694 B2 * 5/2009 Tseng et al. ..... 336/212
2008/0169769 A1 * 7/2008 Lee ..... 315/278

* cited by examiner

*Primary Examiner*—Elvin G Enad
*Assistant Examiner*—Ronald W Hinson
(74) *Attorney, Agent, or Firm*—Raymond J. Chew

(57) ABSTRACT

A bobbin includes a first winding frame to wrap primary winding coils thereon, a first winding chassis defining a first opening to receiving the first winding frame therein, a pair of second winding chassis positioned at two opposite ends of the bobbin and each defining a second opening, a pair of second winding frames received in the second openings of the second winding chassis to wrap secondary winding coils thereon, and a receiving hole extending through the second winding chassis and the first winding frame. The first winding frame is positioned between the second winding chassis. Each of the second winding frames defines a through hole communicating with the receiving hole. The first opening of the first winding chassis faces to a first direction, and each of the second openings of the second winding chassis faces to a second direction different from the first direction.

19 Claims, 4 Drawing Sheets

TRANSFORMER WITH SEPARATED BOBBIN

BACKGROUND

1. Technical Field

The present disclosure generally relates to transformers, and more particularly to a transformer with separated bobbin.

2. Description of Related Art

A transformer has become an essential electronic component for various kinds of electronic devices. FIG. 4 illustrates a schematic diagram of a commonly used transformer 10. The transformer 10 includes a U-U shaped core assembly 13, a pair of primary winding coils 11 positioned on a side of the core assembly 13, and a pair of secondary winding coils 12 positioned on another side of the core assembly 13. A beeline distance D1 between the pair of primary winding coils 11 and the pair of secondary winding coils 12 is great to avoid arcing therebetween, resulting in a large transformer 10, whose design resists attempts to minimize the electronic device.

Therefore, a need exists in the industry to overcome the described limitations.

DETAILED DESCRIPTION

Figure 1:
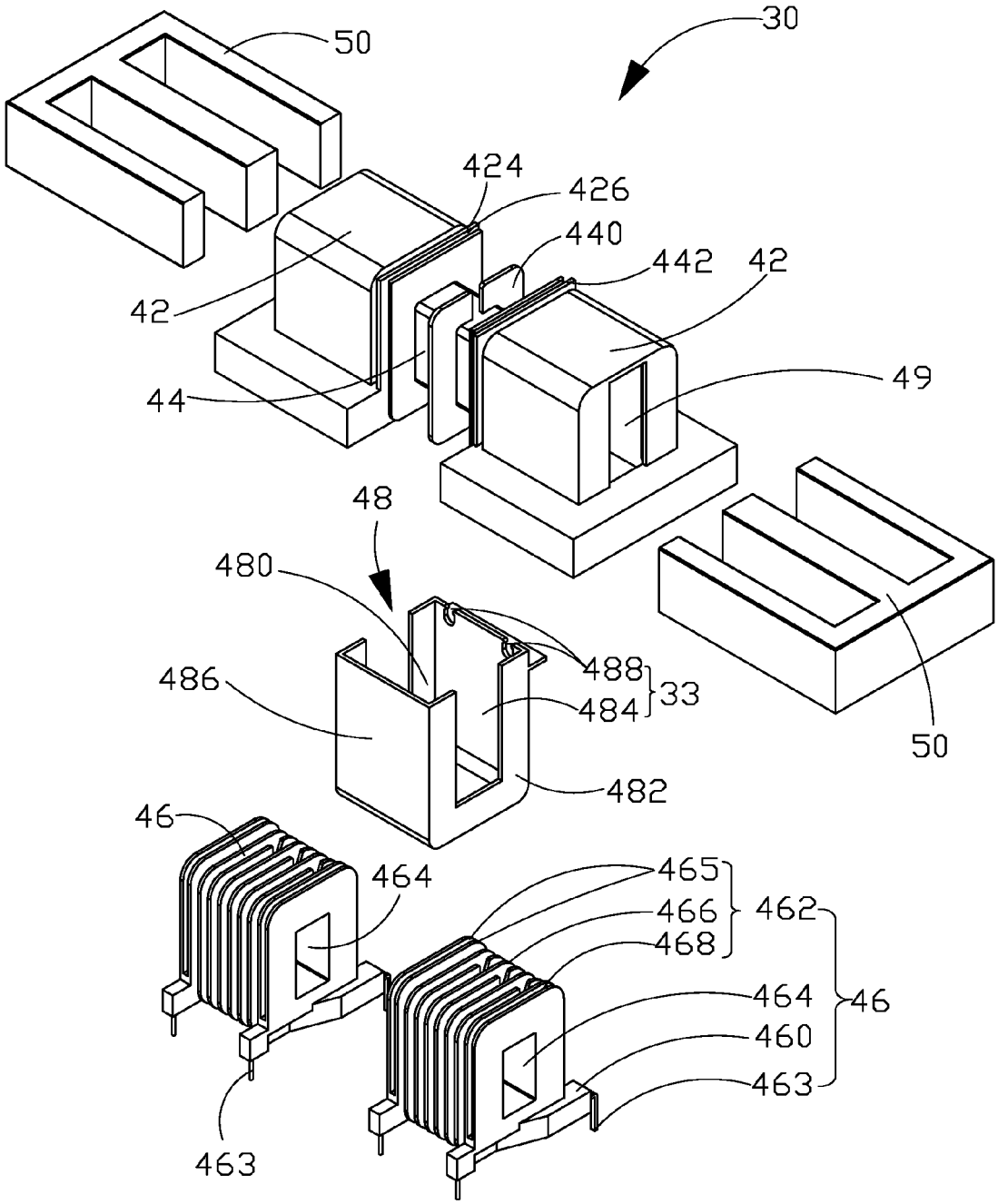
FIG. 1 is an exploded, isometric view of a transformer of the disclosure.

FIG. 1 is an exploded, isometric view of a transformer 30 of the disclosure. The transformer 30 may be disposed on a circuit board of an inverter (not shown) and includes a bobbin (not labeled) and an E-E shaped core assembly 50.

The bobbin includes a bobbin body 40 (referring to FIG. 2) including a first winding frame 44, a pair of second winding chassis 42 positioned at two opposite distal ends thereof, and a receiving hole 49 extending through the pair of second winding chassis 42 and the first winding frame 44 to receive the core assembly 50, a pair of second winding frames 46 to wrap secondary winding coils (not shown) thereon, and a first winding chassis 48 to receive the first winding frame 44 therein. The first winding frame 44 is positioned between the pair of second winding chassis 42 to wrap primary winding coils (not shown) thereon. In the illustrated embodiment, the pair of second winding frames 46 are separated from the second winding chassis 42. The first winding frame 44 is separated from the first winding chassis 48.

Figure 2:
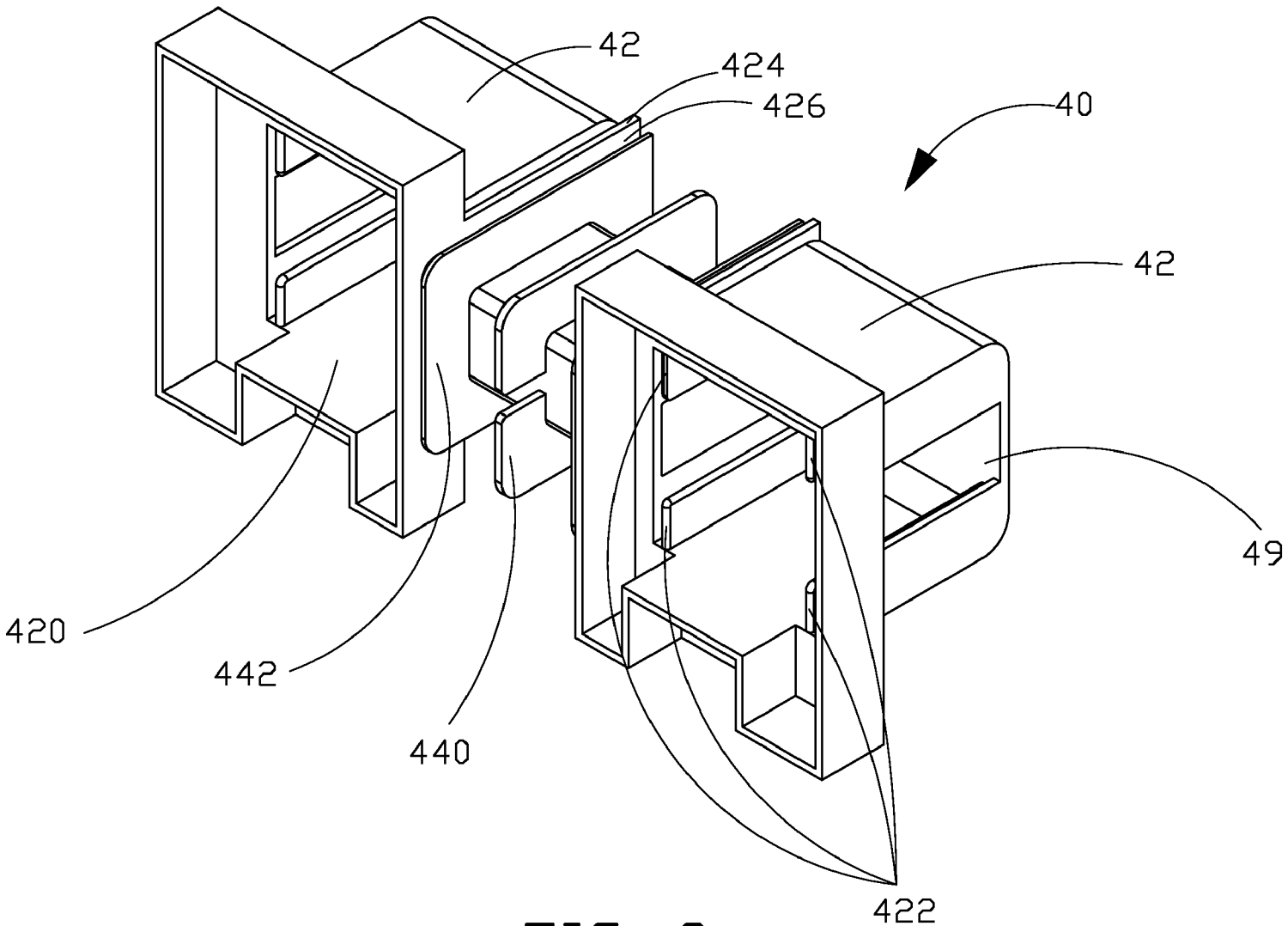
FIG. 2 is an isometric view of a bobbin body of FIG. 1, viewed from another aspect.

FIG. 2 is an isometric view of the bobbin body 40. The first winding frame 44 includes a first partition plate 440 dividing the first winding frame 44 into two regions and a pair of blocking plates 442 positioned at two opposite distal ends thereof. Each of the pair of second winding chassis 42 further includes a first partition wall 424 located at a distal end thereof adjacent to the blocking plate 44. A pair of gaps 426 is formed between each of the pair of blocking plates 442 and each of the pair of first partition walls 424.

Alternatively, the first winding frame 44 can be divided into n+1 regions by n first partition plates 440, where n is an integer from 1 to n.

In the illustrated embodiment, the pair of second winding chassis 42 and the first winding frame 44 are integrally formed.

The first winding chassis 48 defines a first opening 480, a pair of first sidewalls 486, and a pair of second sidewalls 482 mechanically connected to the pair of first sidewalls 486. Each of the pair of second sidewalls 482 defines an aperture 484 communicating with the first opening 480 and the receiving hole 49. One of the pair of first sidewalls 486 defines a pair of slots 488 at a distal end thereof to receive first terminals of the primary winding coils that are electrically connected to the circuit board to electrical connect the primary winding coils of the transformer 30 and the circuit board. After assembly, the pair of second sidewalls 482 is received in the pair of gaps 426 respectively, so that the first winding chassis 48 cannot accidentally disengage from the first winding frame 44.

Each of the second winding chassis 42 includes a second opening 420 to receive a corresponding second winding frame 46 therein, and two pairs of locating plates 422 projecting from an interior wall of the second opening 420 and extending toward each other. A height of each of the two pairs of locating plates 422 is substantially equal to a depth of the second opening 420.

Each of the pair of second winding frames 46 includes a base 460, a winding body 462 projecting from the base 460 to wrap a secondary winding coils thereon, a plurality of pins 463 to fix the transformer 30 on the circuit board, and a through hole 464 extending therethrough and communicating with the receiving hole 49 and the aperture 484. Second terminals of the secondary winding coils are wrapped on the plurality of pins 463 to electrically connect the secondary winding coils of the transformer 30 and the circuit board.

Each of the pair of winding bodies 462 includes two pairs of second partition walls 465, a plurality of second partition plates 466 between the two pairs of second partition walls 465 dividing the winding body 462 into a plurality of regions, and a pair of locating slots 468 between the pair of second partition walls 465. After assembly, the locating plates 422 of each of the second winding chassis 42 are received in the corresponding locating slots 468 of each of the second winding frames 46 to fix the second winding frames 46 in the second winding chassis 42, and the through holes 464 of the second winding frames 46 communicate with the receiving hole 49 and aperture 484 to receive the core assembly 50.

Figure 3:
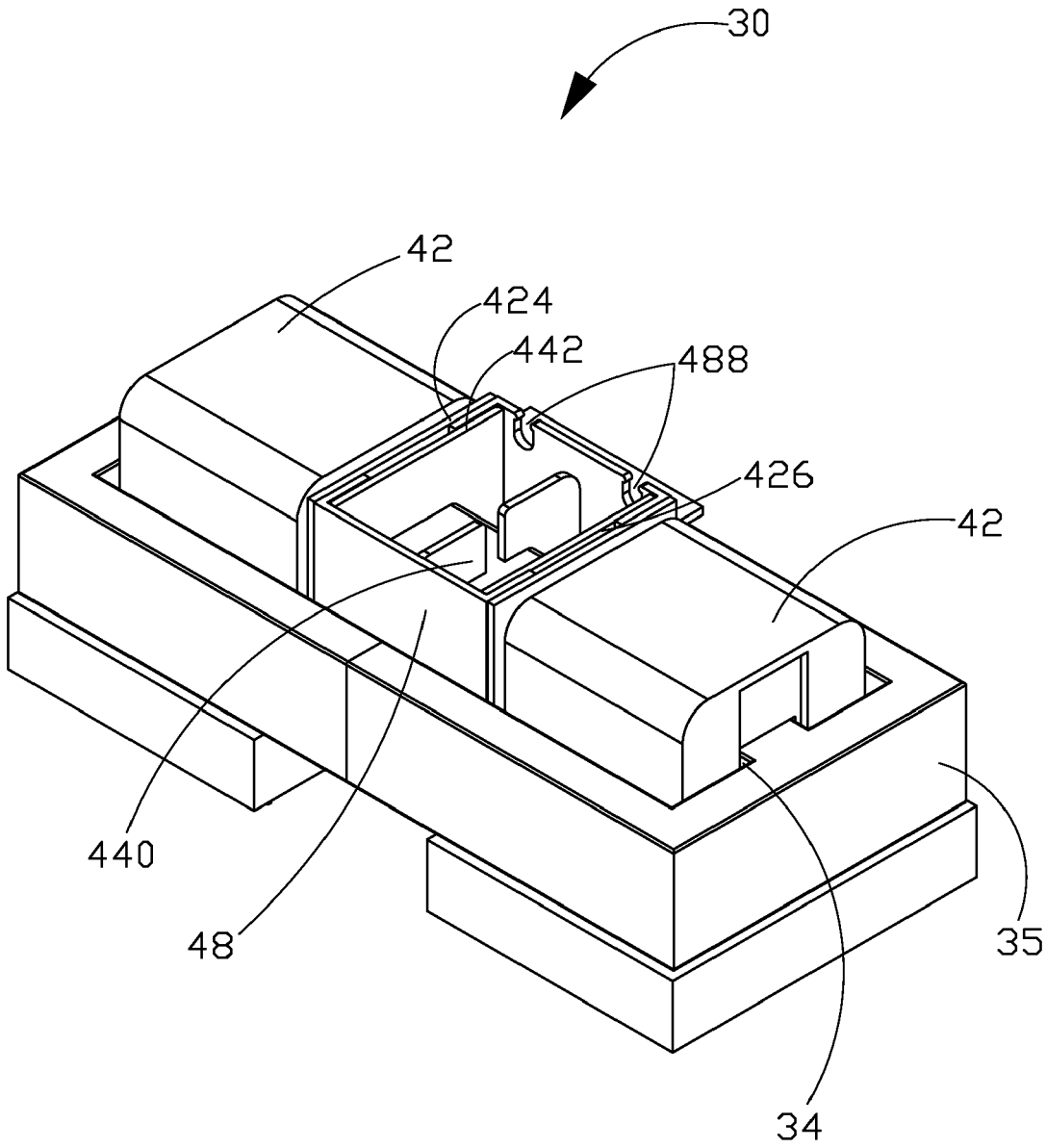
FIG. 3 is an assembled view of FIG. 1.
Figure 4:
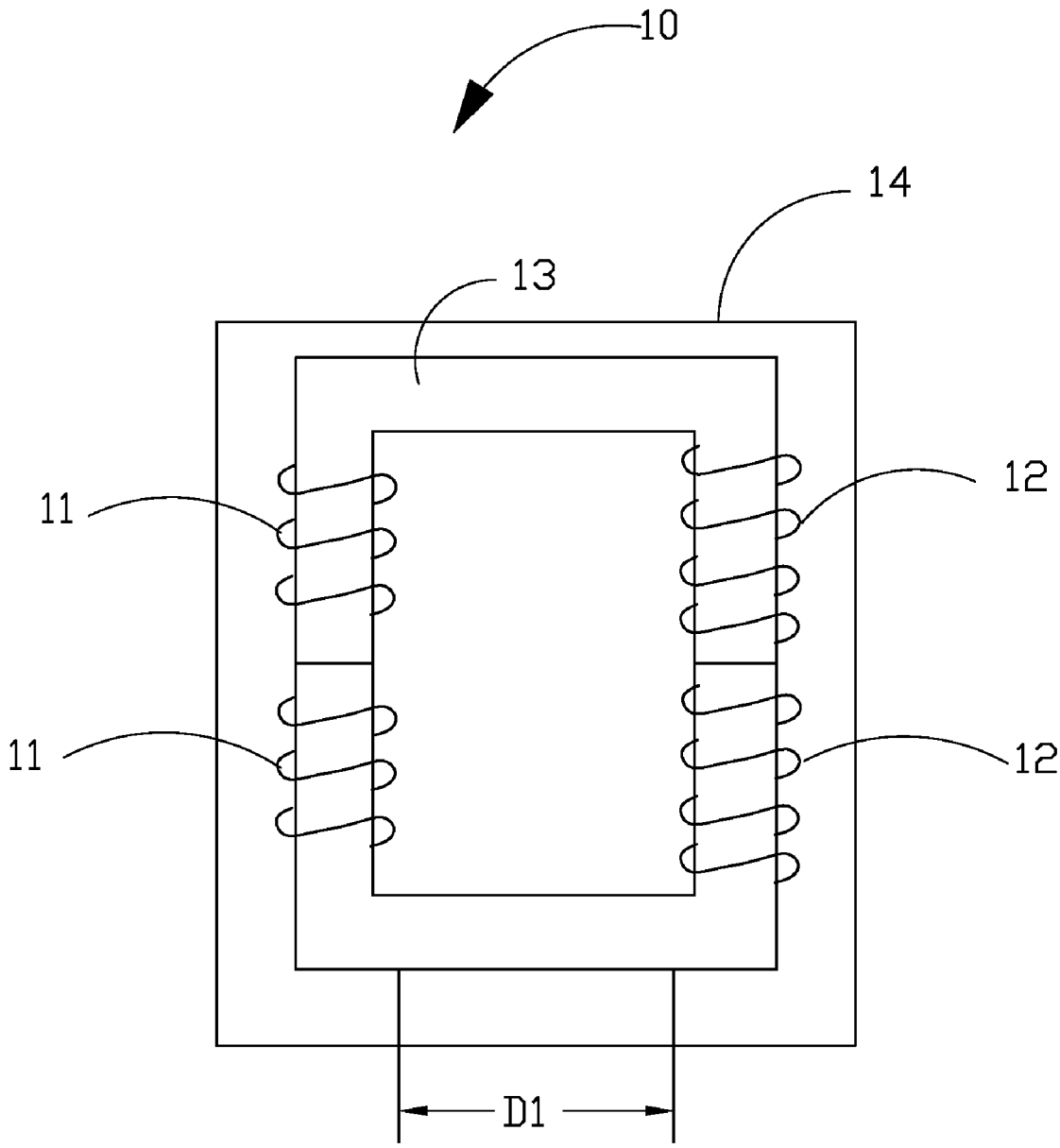
FIG. 4 (RELATED ART)
FIG. 4 is a schematic diagram of a commonly used transformer.

FIG. 3 is an assembled view of the transformer 30 of the disclosure. Each of the pair of second winding frames 46 is received in a corresponding second winding chassis 42, and the first winding frame 44 is received in the first winding chassis 48, with the through holes 464 and the aperture 484 communicating with the receiving hole 49, correspondingly, the core assembly 50 is received in the bobbin. Thus, the bobbin and the core assembly 50 are assembled in the transformer 30. In this position, the first winding chassis 48 is filled with colloid so that the first terminals of the primary winding coils can but creep along just the one first sidewall 486 of the first winding chassis 48 to the slots 488 of the first winding chassis 48 along a first direction facing away from the circuit board to be attached to the circuit board. The second terminals of the secondary winding coils are wrapped, in a second direction opposite to the first direction, on the pins of the second winding frame 46 to be attached to the circuit board. In other words, a creeping distance between the primary winding coils and the secondary winding coils is greater than a sum of a height of the first winding chassis 48 and a height of the second winding frame 46, so that a beeline distance between the primary winding coils and the secondary winding coil can be reduced, as well as profile of the transformer 30 can be reduced.

In the illustrated embodiment, a direction to which the second opening 420 of the second winding chassis 42 is exposed, faces to the circuit board, and a direction to which the first opening 480 of the first winding chassis 48 is exposed, faces away from the circuit board. In other words, the direction to which the first opening 480 faces is the same direction as the first terminals of the primary winding coils extend, and the direction to which the second opening 420 faces is the same direction as the second terminals of the secondary winding coils extend.

Alternatively, the first direction can be substantially perpendicular to the second direction. In other words, if the first direction is different from the second direction, the creeping distance between the primary winding coils and the secondary winding coils is increased.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. A transformer positioned on a circuit board, the transformer comprising:

a core assembly; and a bobbin comprising a first winding frame to wrap primary winding coils thereon, a first winding chassis to receive the first winding frame therein, a pair of second winding chassis positioned at two opposite ends of the bobbin, a pair of second winding frames received in the pair of second winding chassis to wrap secondary winding coils thereon, and a receiving hole extending through the pair of second winding chassis and the first winding frame, wherein each of the pair of second winding frames comprises a plurality of pins mounted in the circuit board to fix the transformer on the circuit board, and a through hole communicating with the receiving hole to receive the core assembly, and wherein the first winding chassis comprises a pair of first sidewalls, and wherein the first winding frame is positioned between the pair of second winding chassis;

wherein first terminals of the primary winding coils creep over one of the pair of first sidewalls of the first winding chassis along a first direction to be attached to the circuit board, and wherein second terminals of the secondary winding coils are wrapped, in a second direction different from the first direction, on the pins of the second winding frame to be attached to the circuit board.

2. The transformer as recited in claim 1, wherein the first direction is opposite to the second direction.

3. The transformer as recited in claim 1, wherein the first direction is substantially perpendicular to the second direction.

4. The transformer as recited in claim 1, wherein the first winding chassis defines a first opening to receive the first winding frame therein and facing to the first direction, a pair of apertures communicating with the first opening, the receiving hole, and the through hole and located in a pair of second sidewalls of the first winding chassis, and a pair of slots located at a distal end of the one first sidewall of the first winding chassis to receive the first terminals of the primary winding coils.

5. The transformer as recited in claim 4, wherein the first winding frame comprises a pair of blocking plates positioned at two opposite distal ends of the first winding frame, and wherein each of the pair of second winding chassis comprises a first partition wall adjacent to the blocking plate.

6. The transformer as recited in claim 5, wherein a pair of gaps is formed between each of the pair of blocking plates and each of the pair of first partition walls to receive the pair of second sidewalls of the first winding chassis.

7. The transformer as recited in claim 1, wherein each of the pair of second winding chassis comprises a second opening to receive a corresponding second winding frame therein and facing to the second direction, and two pairs of locating plates projecting from an interior wall of the second opening and extending toward each other.

8. The transformer as recited in claim 7 wherein a height of each of the two pairs of locating plates is substantially equal to a depth of the second opening.

9. The transformer as recited in claim 7, wherein each of the pair of second winding frames comprises two pairs of second partition walls, a plurality of second partition plates between the two pairs of second partition walls, and a pair of locating slots each between the pair of second partition walls to receive the locating plates.

10. The transformer as recited in claim 1, wherein the first winding chassis is filled with colloid.

11. A bobbin used in a transformer, the bobbin comprising:

a first winding frame to wrap primary winding coils thereon;

a first winding chassis defining a first opening to receiving the first winding frame therein;

a pair of second winding chassis positioned at two opposite ends of the bobbin and each defining a second opening, wherein the first winding frame is positioned between the pair of second winding chassis;

a pair of second winding frames received in the second openings of the pair of second winding chassis to wrap secondary winding coils thereon, wherein each of the pair of second winding frames defines a through hole; and a receiving hole extending through the pair of second winding chassis and the first winding frame and communicating with the through hole;

wherein the first opening of the first winding chassis faces to a first direction, and wherein each of the second openings of the second winding chassis faces to a second direction different from the first direction.

12. The bobbin as recited in claim 11, wherein the first direction is opposite to the second direction.

13. The bobbin as recited in claim 11, wherein the first direction is substantially perpendicular to the second direction.

14. The bobbin as recited in claim 11, wherein each of the pair of second winding chassis comprises two pairs of locating plates projecting from an interior wall of the second opening and extending toward each other.

15. The bobbin as recited in claim 14, wherein a height of each of the two pairs of locating plates is substantially equal to a depth of the second opening.

16. The bobbin as recited in claim 14, wherein the first winding chassis defines a pair of slots located at a distal end of a first sidewall of the first winding chassis, and a pair of apertures communicating with the first opening, the receiving hole, and the through hole, and located in a pair of second sidewalls of the first winding chassis.

17. The bobbin as recited in claim 16, wherein the first winding frame comprises a pair of blocking plates positioned two opposite distal ends of the first winding frame, and wherein each of the pair of second winding chassis comprises a first partition wall adjacent to the blocking plate.

18. The bobbin as recited in claim 17, wherein a pair of gaps is formed between each of the pair of blocking plates and each of the pair of first partition walls to receive the pair of second sidewalls of the first winding chassis.

19. The bobbin as recited in claim 14, wherein each of the pair of second winding frames comprises two pairs of second partition walls, a plurality of second partition plates between the two pairs of second partition walls, and a pair of locating slots each between the pair of second partition walls to receive the locating plates.

* * * * *